US007452451B2

(12) United States Patent
Kitada et al.

(10) Patent No.: US 7,452,451 B2
(45) Date of Patent: Nov. 18, 2008

(54) ELECTRODE PLATE AND ELECTROLYSIS APPARATUS FOR ELECTROLYIS, ELECTRODE PLATE UNIT, AND METHOD FOR ELECTROLYZING COMPOUND COMPRISING HYDROGEN

(75) Inventors: Masayoshi Kitada, Saitama (JP); Kosuke Niki, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 565 days.

(21) Appl. No.: 10/901,062

(22) Filed: Jul. 29, 2004

(65) Prior Publication Data

US 2005/0051426 A1 Mar. 10, 2005

(30) Foreign Application Priority Data

Sep. 5, 2003 (JP) ..... 2003-314340

(51) Int. Cl.
*C25B 11/04* (2006.01)

(52) U.S. Cl. ..... 204/291; 204/280; 204/292; 204/278.5

(58) Field of Classification Search ..... 204/280, 204/292, 291, 278.5
See application file for complete search history.

(56) References Cited

U.S. PATENT DOCUMENTS

| | | | | |
|---|---|---|---|---|
| 2004/0076563 | A1 * | 4/2004 | Kitada | 422/211 |
| 2005/0175517 | A1 * | 8/2005 | Kitada | 422/186 |
| 2005/0274607 | A1 * | 12/2005 | Kitada et al. | 204/230.2 |

FOREIGN PATENT DOCUMENTS

| | | | |
|---|---|---|---|
| JP | 04-059601 | | 2/1992 |
| WO | WO02060576 | A1 * | 8/2002 |
| WO | WO 03064318 | A1 * | 8/2003 |
| WO | WO 2004031450 | A1 * | 4/2004 |

* cited by examiner

*Primary Examiner*—Bruce F Bell
(74) *Attorney, Agent, or Firm*—Arent Fox LLP

(57) ABSTRACT

An electrode plate for electrolysis is composed of a plate-form porous ceramic body for electrolyzing a hydrogen-comprising-compound solution, and a conductive portion provided at a part of the ceramic body, wherein particles for composing the ceramic body are comprised of any of fluoride carbon and an element difficult to react to oxygen, and wherein an outmost-nucleus-orbit electron number of the element is even, and porosity having an energy concentration field is provided between the particles in the ceramic body.

42 Claims, 7 Drawing Sheets

ELECTRODE PLATE AND ELECTROLYSIS APPARATUS FOR ELECTROLYIS, ELECTRODE PLATE UNIT, AND METHOD FOR ELECTROLYZING COMPOUND COMPRISING HYDROGEN

BACKGROUND OF THE INVENTION

1. Field of the Invention

The present invention relates to an electrode plate for electrolyzing a solution of a compound comprising hydrogen (hereinafter referred to as a "hydrogen-comprising-compound solution" as needed) at low energy and an electrolysis apparatus that uses the electrode plate and can implement electrolysis at low energy, and in particular, to the electrode plate and the electrolysis apparatus using the same for efficiently electrolyzing a compound comprising hydrogen (hereinafter referred to as a "hydrogen-comprising-compound") such as an organic compound, which is liquid in an operation condition like low alcohol, at the low energy. The present invention further relates to an electrode plate unit that can stably generate a large amount of hydrogen. In addition, the present invention relates to a method of using such the electrolysis apparatus and electrolyzing the hydrogen-comprising-compound solution.

2. Description of the Related Art

These years from viewpoints of a depletion of an existing resource such as petroleum and an environmental protection such as a discharge suppression of carbon dioxide, hydrogen is taken notice of as an alternative fuel for replacing the petroleum.

Conventionally, in order to manufacture the hydrogen as such an energy source, electrolysis of water is general.

For example, in electrolyzing water hydrogen is generated according to a following equation (1):

$$H_2O \rightarrow H_2 + 1/2O_2. \quad (1)$$

In this case, although in order to obtain the hydrogen by electrolyzing the water, a potential difference of 1.23V is needed, it is impossible to electrolyze the water due to a high electric resistance thereof unless the potential difference not less than 1.23 V is given to the water. Therefore, although in order to generate the hydrogen, a solution where an electrolyte such as alkali is dissolved is electrolyzed, it is necessary to remove an alkali compound generated as a byproduct and there is also a problem that a decomposition ratio is low.

As another method for generating hydrogen, a thermal decomposition of water is thought. However, in order to obtain the hydrogen by thermally decomposing the water, it is necessary to decompose it under a high temperature of around 4,300 degrees Celsius and thereby larger energy is needed, so it is not practical.

In addition, because although as a method for generating the hydrogen without adding external energy, it is thought the method for chemically reacting a metal and the water by adding an alkali metal such as aluminum, magnesium, or sodium, or an alkali earth metal, these metals are comparatively expensive and these chemical reactions are rapid, so it is difficult to industrially utilize the method.

In addition, at pages 1 and 2 of Japanese Patent Laid-Open Publication Hei 4-59601 is described a method for obtaining hydrogen from water with using a silicon particle whose particle diameter is from 30 μm to 150 μm.

However, in the method a hydrogen generation reaction is unstable and nothing but a very little amount of hydrogen can be generated.

In addition, conventionally, in a method for obtaining hydrogen from methanol, it is said that a temperature not less than 200 degrees Celsius is necessary in order to reform the methanol and obtain the hydrogen, and reforming is generally implemented at a few hundred temperature. In addition, because a generation of byproducts such as CO and $CO_2$ is accompanied in a reaction of the reforming, it is difficult to use the hydrogen obtained by the reforming of the methanol as clean energy as it is, so it is necessary to take a countermeasure for removing the byproducts.

Therefore, there is a strong request for an electrolysis technology that does not accompany the generation of the byproducts such as CO and $CO_2$ and can implement electrolysis at low energy.

Accordingly, there is a first request for providing an electrode plate for electrolysis that can implement the electrolysis at low energy, particularly the electrolysis of a hydrogen-comprising-compound solution. There is a second request for providing an electrolysis apparatus that can implement the electrolysis at low energy. Furthermore, there are third and fourth requests for implementing the electrolysis at the low energy, particularly the electrolysis of the hydrogen-comprising-compound solution, and providing an electrode plate unit, which can stably provide a large amount of hydrogen, and a novel electrolysis method of the hydrogen-comprising-compound solution.

SUMMARY OF THE INVENTION

In order to meet the first request described above, the present invention is an electrode plate for electrolysis that comprises a plate-form porous ceramic body for electrolyzing a hydrogen-comprising-compound solution and a conductive portion provided at a part of the ceramic body; wherein particles for composing the ceramic body are comprised of any of fluoride carbon and an element difficult to react to oxygen; wherein an outmost-nucleus-orbit electron number of the element is even; and wherein porosity having an energy concentration field is provided between the particles in the ceramic body.

Thus composed, when because the electrolysis is implemented by the electrode plate for the electrolysis formed into a porous plate form that has the energy concentration field between the predetermined particles, a voltage is applied to the electrode plate, the hydrogen-comprising-compound solution of a treated substance stays at the energy concentration field and passes through it; energy is given; the hydrogen-comprising-compound solution is ionized and thereby becomes a conductor; and thus the electrolysis can be implemented at low energy.

In the electrode plate for the electrolysis of the present invention the element is designed to be an element of a simple constituent selected from a group comprising silicon, titan, nickel, and samarium.

The electrode plate composed of such the element can efficiently and stably electrolyze a hydrogen-comprising-compound solution.

In the electrode plate for the electrolysis of the present invention the ceramic body is composed of particles whose diameter is from 30 μm to 150 μm.

Composing the ceramic body of the particles of such the particle diameter, it can be made to efficiently electrolyze a hydrogen-comprising-compound solution.

In order to meet the second request, an electrolysis apparatus of the present invention comprises at least a pair of electrode plates for electrolysis of the present invention, a power source that is connected to a conductive portion of the electrode plates for the electrolysis through conducting wires and applies a voltage to the conducting portion, and a vessel for accommodating the electrode plates for the electrolysis and a hydrogen-comprising-compound solution, wherein the vessel has a gas discharge port.

Thus composed, is provided the electrolysis apparatus that can electrolyze the hydrogen-comprising-compound solution at low energy.

In an electrolysis apparatus of the present invention the power source applies a voltage so as to periodically change a potential for the electrode plates.

Thus composed, it can be made to stably implement electrolysis over a long period. Meanwhile, a gas discharge port is specifically preferable to be provided with a separator for separating a gas generated by the electrolysis. Thus composed, a gas such as hydrogen obtained by the electrolysis can be selectively recovered.

In an electrolysis apparatus of the present invention the power source applies a voltage of a rectangular wave to the electrode plates.

Thus composed, an electrolysis reaction is accelerated by supplying a current of the rectangular wave, where a rise of the voltage is steep, to the electrode plates.

An electrolysis apparatus of the present invention comprises each of the electrode plates as an electrode plate unit; a first electrode group that arranges a plurality of the electrode plates at a predetermined distance in parallel with a face direction thereof, and one end of the plurality of the electrode plates is fixed by a conductive fixation jig; and a second electrode group that arranges a plurality of the electrode plates at a predetermined distance in parallel with a face direction of the plurality of the electrode plates, and one end of the plurality of the electrode plates is fixed by another conductive fixation jig, wherein in the electrode plate unit each free end of the first electrode group and the second electrode group is made face to face, each of the electrode plates for composing each of the electrode groups is arranged not to contact each other and the opposed conductive fixation jigs, the first electrode group and the second electrode group are fixed by the conductive fixation jigs in a vertical direction of a face of the electrode groups, and a conductive portion of each of the electrode plates is formed so as to contact the conductive fixation jig of each of the electrode groups.

Thus composed, it can be made to continuously/stably implement electrolysis for a long period.

In order to meet the third request, an electrode plate unit for electrolysis of the present invention is the unit for the electrolysis for electrolyzing a hydrogen-comprising-compound solution, which unit is composed of a first electrode group, where a plurality of the electrode plates for the electrolysis are arranged at a predetermined distance in parallel with a face direction of the electrode plates and each one end of a plurality of electrode plates is fixed by a conductive fixation jig; and a second electrode group, where a plurality of the electrode plates are arranged at a predetermined distance in parallel with a face direction of the plurality of the electrode plates and each one end of the plurality of the electrode plates is fixed by another conductive fixation jig, and wherein each free end of the first electrode group and the second electrode group is made face to face, each electrode plate for composing each the electrode group is arranged not to contact each other and the conductive fixation jigs which each electrode plate faces, then each electrode plate is fixed by the conductive fixation jig in a vertical direction of a face of each the electrode group, and a conductive portion of each the electrode plate is formed so as to contact the conductive fixation jig of each the electrode group.

Thus composed, it can be made to continuously and stably implement the electrolysis for a long period.

In order to meet the fourth request, an electrolysis method of a hydrogen-comprising-compound solution of the present invention is the method that electrolyzes the hydrogen-comprising-compound solution, using an electrolysis apparatus; applies a voltage to the electrode plates; stops a process of electrolyzing the hydrogen-comprising-compound solution under heating and an application of the voltage, and comprises a process of continuing on electrolyzing the hydrogen-comprising-compound solution under heating.

Thus composed, it can be made to electrolyzing the hydrogen-comprising-compound solution over a long period.

DESCRIPTION OF THE PREFERRED EMBODIMENTS

Here will be described embodiments of the present invention in detail, referring to drawings as needed.

[Electrode Pate for Electrolysis]

First, an electrode plate for electrolysis (hereinafter simply referred to as the electrode plate) will be described, based on FIGS. 1A and 1B.

Figure 1A:
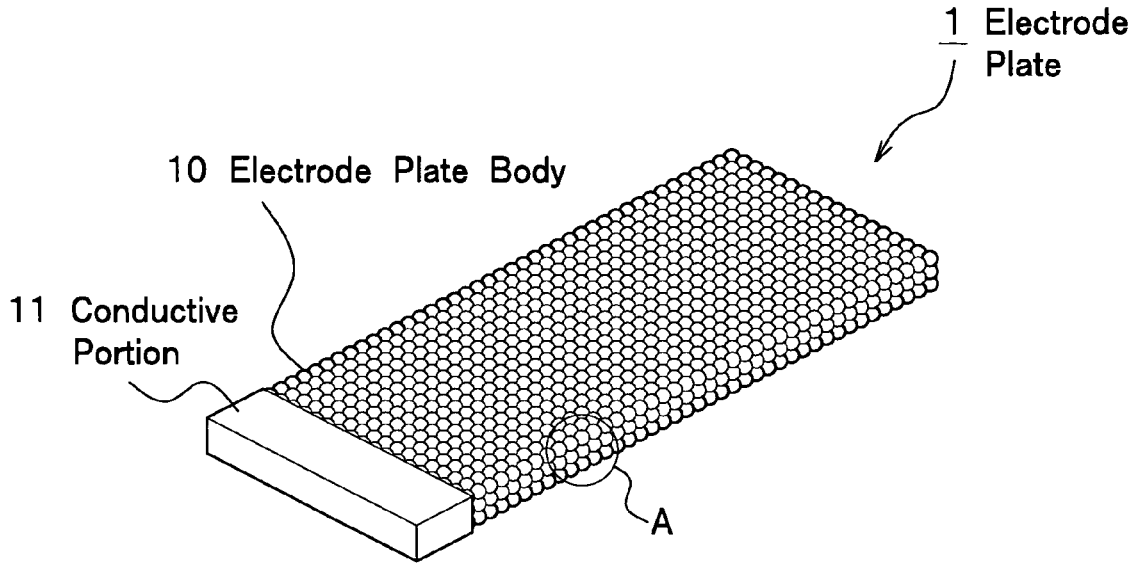
FIG. 1A is a perspective view showing an electrode plate in the present invention.

As shown in FIG. 1A, an electrode plate 1 is mainly composed of an electrode plate body 10 comprised of a porous ceramic and a conductive portion 11 provided at the electrode plate body 10.

In the embodiment particles P for composing the electrode plate body 10 consists of an element selected from a group comprising silicon, titan, nickel, and samarium. Out of these elements, silicon, titan, and nickel are metal elements each of which planetary electron number of their outmost nucleus orbit (M, N) is even and which elements are difficult to react to oxygen. In addition, with respect to samarium it is a rare earth metal of which planetary electron number of its outmost nucleus orbit (M, N) is even (2) and which metal is difficult to react to oxygen. Meanwhile, nickel and samarium is characterized by having strong magnetism.

In the electrode plate 1 the particles P for composing the porous ceramic of the electrode plate body 10 use these elements as a simple substance, and then, when although purity is appropriately selected, depending on such a kind of an element used and a hydrogen-comprising-compound that is electrolyzed, for example, electrolyzing low alcohol such as methanol, using silicon, purity of silicon is not less than 90%, preferably 95%. The higher the purity is, the more preferable it is. Other elements that can compose the electrode plate, that is, titan, nickel, and samarium are preferably same in purity thereof.

Although in the electrode plate 1 such a specific element is pelletized into particles, the particles are preferably spherical, particularly true spherical from a viewpoint of arrangement easiness into predetermined positions described later, pelletizing easiness and the like; and then, a particle diameter is preferably from 5 μm to 80 μm. It is comparatively difficult to manufacture particles having a particle diameter of not more than 5 μm and comparatively becomes difficult to pass a substance through spacing of the particles, which is an energy concentration field described later, when arranging them at the predetermined positions. In addition, when the particle diameter exceeds 80 μm, sufficient energy is not generated between the particles in arranging them. Generally, if the particle diameter exceeds 150 μm, it becomes difficult to electrolyze them.

In addition, the narrower a particle size distribution of the particles is, the more preferable it is. To be more precise, as a result of repeated preparatory experiments of the inventor et al., it turned out that a remarkable effect can be brought out when a variation of the particle diameter is within ±15 μm (that is, an absolute error of the particle diameter is within 30 μm). However, the present invention is not limited to such the particle size distribution of the particles.

A method for pelletizing the specific element in the present invention into a predetermined shape is not specifically limited and a generally known pelletizing method in a catalyser manufacturing field is applicable. A gas atomization method is preferable from a viewpoint that manufacturing is simple and particle shapes can be made comparatively uniform. However, the electrode plate body 10 is not specifically limited to the gas atomization method if the particles described above are formed, for example, a conventional known method such as a sol-gel method can be preferably used.

First, arrange the particles P, which are composed of any of elements selected from a group comprising silicon, titan, nickel, and samarium, at positions that amplify wavy energy. In other words, each of the elements for composing the electrode plate body 10 has a unique frequency expressed by an equation: $E=h\nu$ (where E is unique ionization energy (eV) of each element, h is Planck's constant, and ν is a frequency), for example, as shown in Table 1 in ionization, and each of the elements for composing the electrode plate body 10 oscillates an electromagnetic field oscillation. And such the electromagnetic field oscillation has a predetermined fluctuation. From this, each of the elements for composing the electrode plate body 10 is surmised to have a unique oscillation in a normal state; and as shown in FIG. 1B, gives oscillation energy to a substance (that is, the hydrogen-comprising-compound solution) passing through and staying in an air gap S formed between the particles P by arranging the particles P at positions, where the unique oscillation is effectively given to each of the elements; excites the substance; ionizes it, and makes all of the electrode plate body 10 a conductor, and therefore, electrolysis of the substance is surmised to be accelerated.

TABLE 1

| Element | Ionization Energy (eV) | Frequency ($\times 10^{15}$ Hz) |
|---|---|---|
| Si | 8.144 | 1.971 |
| Ni | 7.63 | 1.846 |
| Ti | 6.82 | 1.649 |
| Sm | 5.63 | 1.361 |

In addition, although it is not clear by what-like reason a same action/effect is shown, the inventor has found that fluoride carbon (FC) also shows the same action/effect as in a case of using the metal elements when he further repeatedly performed experiments.

Figure 1B:
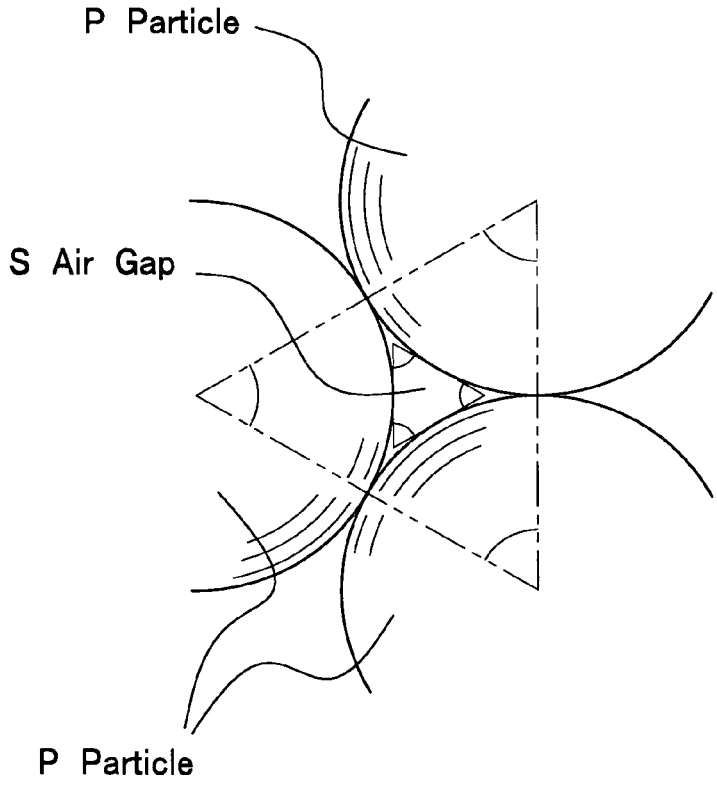
FIG. 1B is a schematic drawing, where a portion A in FIG. 1A is enlargedly shown, for illustrating an arrangement of particles composing the electrode plate of the present invention.

First, if when in the electrode plate 1 each the particle P for composing the electrode plate body 10 is assumed to be substantially a uniform size (true sphere having a same particle diameter), each the particle P is arranged, for example, as shown in FIG. 1B, at an apex of a triangle, preferably an equilateral triangle, each the particle P is found to show high activation. That is, when in the present invention the hydrogen-comprising-compound solution passes through and stays in the air gap S (energy concentration field) between the particles P composed of the specific element, high energy is given to the hydrogen-comprising-compound thanks to a unique oscillation/fluctuation and the like of each element, which composes the electrode plate body 10. If the high energy is given, the hydrogen-comprising-compound is surmised that it excites in the air gap S (energy concentration field) between the particles P in the electrode plate body 10, discharges ions, and the electrode plate body 10 becomes a conductor. (Meanwhile, with respect to giving of energy and ionization, for example, refer to "All of Active Oxygen/Free Radical-From Health to Environment," written by Toshikazu YOSHIKAWA, et al., Maruzen, July 2000).

In addition, the embodiment arranges the particles P, which are composed of a predetermined element, at such the positions. Meanwhile, because in fact each particle does not always become a complete sphere and a particle diameter thereof is not constant, it is practically difficult to accurately arrange each particle at each apex of an equilateral triangle. A terminology "arrange each particle at each apex of an equilateral triangle" means that such an error range is included therein.

When arranging the particles P at apexes of the equilateral triangle, a triangle formed in the air gap S between the particles P, that is, each apex angle of the triangle formed of intersections of tangents of the particles P is requested to be not more than 90 degrees, preferably 39 to 70.5 degrees, and ideally about 60 degrees.

In addition, in the embodiment it is found that highest activation is indicated when each particle is arranged at apexes of a tetrahedron. That is, when although in forming the electrode plate body 10 the particles P are stacked into a porous ceramic body (electrode plate body 10), making the particle arrangement of an equilateral triangle as a basis, the hydrogen-comprising-compound electrolyzed passes through and stays in the air gap S (energy concentration field) between the particles P composed of a specific element, then a tetrahedron structure becomes a structure where a (equilateral) triangle structure, which gives high energy to the substance, is arranged at four faces, and a higher energy concentration field is constituted by such a unique oscillation/fluctuation of each element for composing the electrode plate body 10 of the embodiment.

In addition, the positions that amplify the wavy energy in the present invention are not limited to those of the apexes of the tetrahedron described in the embodiment: If when the substance passes through and stays in the air gap S (energy concentration field) between the particles P composed of the specific element, high energy can be given to the substance at the positions thanks to the unique oscillation/fluctuation and the like of each element, the positions are not specifically limited. That is, when particles of irregular shapes are randomly arranged, a unique oscillation in each element cancels each other and a high energy field becomes difficult to be generated in the air gap S existing between each particle.

The embodiment can mold such the particles by various methods such as a compression molding and a sinter molding. That is, as shown in FIG. 1B, arrange each of the particles P composed of any of a simple constituent element selected from a group comprising silicon, nickel, titan, and samarium; and fluoride carbon so as to be arrayed at the air gap S, which amplifies unique wavy energy in any of each the element and the fluoride carbon, typically at an apex of an equilateral triangle, preferably a tetrahedron. And under heating, for example, by heating the particles P at a temperature not more than a melting temperature thereof and compressing them, the electrode plate 1 as shown in FIG. 1A can be obtained.

In the electrode plate 1, as shown in FIGS. 1A and 1B, are formed many air gaps S of energy concentration fields between the particles P. That is, when molded in to a plate form, the electrode plate 1 activates (excites) the hydrogen-comprising-compound solution, which stays in and passes through the air gaps S, and makes the hydrogen-comprising-compound solution discharge ions by arranging the particles P composed from any of silicon, titan, nickel, samarium, and fluoride carbon at the positions, which amplify the unique wavy energy in any of each the element and the fluoride carbon.

Meanwhile, although the electrode plate 1 can be made various sizes depending on applied purposes, a thickness thereof is from 350 μm to 1,500 μm, preferably from 500 μm to 1,000 μm (that is, a state where particles composing the electrode plate 1 are stacked by 5 to 15 layers is preferable) in order to efficiently lead (stay and pass) the hydrogen-comprising-compound solution to the energy concentration field.

When the thickness is smaller than the above range, care for handling has to be taken not to cause a breakage and the like; on the contrary, when the thickness is larger than the above range, in some case the hydrogen-comprising-compound solution cannot be sufficiently led to the energy concentration field in the electrode plate body 10.

As a whole of a structural body, the electrode plate body 10 is preferably in a range of 45 to 60%, specifically, about 50% in an air gap ratio. Using the electrode plate body 10 having the above range in the air gap ratio, it can be made to lead the hydrogen-comprising-compound solution to the energy concentration field in the electrode plate body 10 with a comparatively little flow amount (pressure) and to excite the hydrogen-comprising-compound. When the air gap ratio of the electrode plate body 10 is larger than the above range, some external action such as a high pressure is requested for exciting the hydrogen-comprising-compound and in some case occurs a clogging of the air gaps S of the energy concentration field due to a breakage of the electrode plate body 10 and impurities in the hydrogen-comprising-compound solution. On the contrary, when the air gap ratio of the electrode plate body 10 is smaller than the above range, in some case the hydrogen-comprising-compound solution of a treated substance is difficult to be activated (excited) because staying-in/passing-through time cannot be sufficiently spared at the energy concentration field of the electrode plate body 10. Meanwhile, a most preferable air gap ratio of the electrode plate body 10 is about 50%.

The conductive portion 11 in the electrode plate 1 is provide at a predetermined place of the electrode plate body 10, preferably at an end thereof, and is a connection portion for connecting a conductor when applying a voltage from a power source not shown. Such the conductive portion 11 can be formed, for example, by providing an aluminum foil and the like at a part of the electrode plate body 10.

However, if a material and shape of the conductive portion 11 achieves a purpose of applying a voltage to the electrode plate body 10 within a range of the present invention, they are not specifically limited thereto.

Here will be described a manufacturing method of an electrode plate of the embodiment.

(Manufacturing of Particles: Step A)

First, form particles composed of any of the predetermined elements and fluoride carbon, which becomes a fundamental unit of the electrode plate body 10. A forming method of the particles is as described before.

That is, for example, by a known method in a manufacturing field of catalytic particles such as the gas atomization method and the sol-gel method, form spherical particles, specifically true spherical ones.

(Antistatic Treatment: Step B)

Next, for a purpose of easily performing an arrangement of spacing of each particle, implement an antistatic treatment for the particles formed in step A. That is, in some case the formed particles cannot be arranged at desired positions with the particles adhering to or repelling each other due to static in arraying them. In addition, in some case particulates around 1 μm and foreign matters, which are concurrently produced in step A, electrostatically adheres to air gaps between the particles and clogs them or deforms them. In order to prevent these, it is preferable to implement the antistatic treatment by dispensing both of an anion/cation to the particles.

(Sintering Treatment: Step C)

As shown in FIG. 1B, arrange the particles P composed of any of the predetermined elements and fluoride carbon, where the antistatic treatment is thus dispensed, and implement sinter molding thereof into a predetermined shape. A sintering condition then is: a temperature not more than a meting temperature of any of the predetermined elements and the fluoride carbon for composing applied particles, and a temperature where the sinter molding can be implemented (for example, 1,200 to 1,300 degrees Celsius when using silicon); a sintering time of 2.5 to 3.5 hours; and a sintering pressure of 12 to 25 MPa. (Meanwhile, because the fluoride carbon is inadequate for sintering, a predetermined shape thereof is made, for example, by CIP (Cold Isostatic Press).)

Thus implementing the sinter molding, is obtained the electrode plate body 10, which has an array shown in FIG. 1B and a shape shown in FIG. 1A.

The electrode plate body 10 of the embodiment is characterized by implementing the sinter molding without using a binder different from a normal sinter molding when it is formed. In other words, if implementing the sinter molding using a conventional known binder, it is difficult to make the electrode plate body 10 with uniformly arranging the air gap S that is, an energy concentration field, between each of the particles; impurities deriving from the binder adhere to surfaces of particles; and thereby there is a possibility that activation of the particles is lost. Of course, if the spacing of the particles can be arranged and the adherence of the impurities to the surfaces thereof can be prevented, it can also be made to implement the sinter molding with using the binder. So the manufacturing method of an electrode plate of the present invention is not limited to whether or not the binder is used. The sintering temperature in using the binder is not less than a decomposion temperature thereof.

Next, form the conductive portion 11 at a predetermined place of the electrode plate body 10 thus formed. For example, as the conductive portion 11, it can also be made to provide an aluminum foil by conventional known methods such as adhesion and vapor deposition. In another embodiment of the present invention it can also be made to directly provide conducting wires at the electrode plate body 10. In this case the conducting wires compose the conductive portion 11 as it is.

(Electrolysis)

Next, will be described electrolysis for using the electrode plate 1 of the embodiment, based on FIGS. 2A to 2C.

The embodiment electrolyzes a hydrogen-comprising-compound, using the electrode plate 1 shown in FIG. A. In this case the hydrogen-comprising-compound, which can be electrolyzed, comprises water; water-based medium (electrolytic water solution and the like); and an organic compound, which is liquid in an operation condition, containing hydrogen, specifically a hydrogen-comprising organic compound having a polarity such as low alcohol: that is, the hydrogen-comprising-compound means a compound that has an OH group, a CH group, and the like, and is liquid in an operation temperature.

Meanwhile, the hydrogen generation mechanism of the embodiment is different from "Hydrogen Generation Mechanism by Active Structural Body" formerly filed by the inventor, et al. (International Publication WO 02/060576 pamphlet) in a point of the embodiment positively giving a voltage to electrodes in addition to activation of the hydrogen-comprising-compound.

In other words, because when in the embodiment the electrode plate 1 composed of at least a pair of porous ceramic bodies is dipped in the hydrogen-comprising-compound provided for electrolysis, the hydrogen-comprising-compound staying in the electrode plate 1 is activated, the electrode plate 1 is thought to become a conductor. Therefore, although it is usually difficult to electrolyze water and the like in such the porous ceramic bodies, it can be firstly made to electrolyze various hydrogen-comprising-compounds by the electrode plate 1 of the embodiment.

In addition, when dipping the electrode plate 1 composed of the porous ceramic bodies in a hydrogen-comprising-compound solution, the hydrogen-comprising-compound is ionized on an interface of the electrode plate 1 and the hydrogen-comprising-compound and in air gaps of the porous ceramic bodies. Therefore, when applying a voltage to the electrode plate 1, the electrode plate 1 of the present invention receives a current, transmits it as a so called antenna material, and thereby an action of applying an electromagnetic stimulus to the hydrogen-comprising-compound occurs.

For example, when as a hydrogen-comprising-compound, electrolyzing methanol ($CH_3OH$) where such an electrolyte is not added with using an electrode plate (Si) of the embodiment at a normal pressure and a temperature of 20 to 63 degrees Celsius, it turns out that an electrolysis reaction proceeds over 20 hours by maintaining the temperature. Meanwhile, it is firstly achieved by the present invention to electrolyze alcohols thus without adding the electrolyte. Moreover, as described in examples described later, when electrolyzing the methanol with using an electrode plate of the present invention, it is preferable in a point that there is no generation of CO of a harmful substance.

Furthermore, because the electrode plate 1 of the embodiment also acts, as described in the pamphlet of International Publication WO 02/060576, as an active structural body, hydrogen can be generated over a long period by repeating an application and shut-off of a voltage. That is, when implementing electrolysis with using the electrode plate 1 of the embodiment, bubbles are generated inside due to the electrolysis just after the voltage is applied to the electrode plate 1. These bubbles move from an inside to surface side of the electrode plate 1.

When although moving time of the bubbles at this time differs, depending on a thickness of the electrode plate 1, a hydrogen-comprising-compound electrolyzed, and the like, for example, electrolyzing methanol by an electrode plate with a thickness of 0.5 mm, discharge time of bubbles generated inside is one second or so.

After then, even if the voltage is not applied, an electrolysis phenomenon continues. Accordingly, the present invention relates to an electrolysis method of the hydrogen-comprising-compound comprising such the application and application stop processes of the voltage. Such the electrolysis method is preferable from a viewpoint of energy reduction.

Figure 2A:
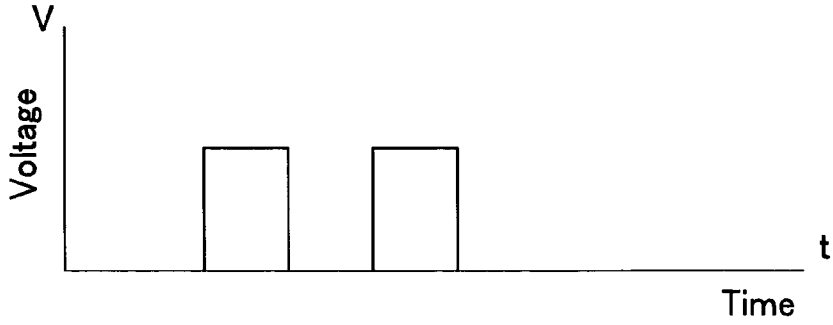
FIGS. 2A, 2B, and 2C are time charts showing each relationship between a voltage applied to an electrode plate of the present invention and time.
Figure 2B:
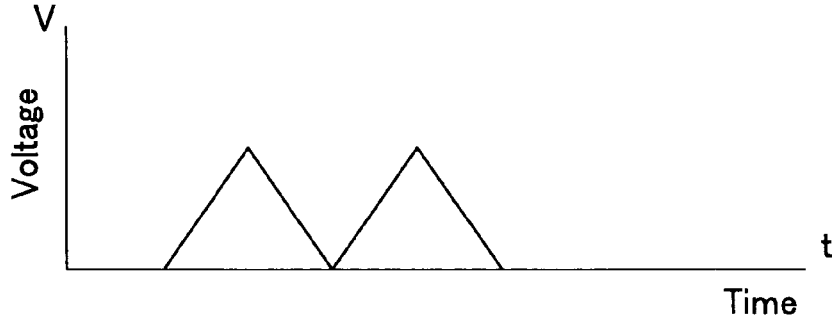
Figure 2C:
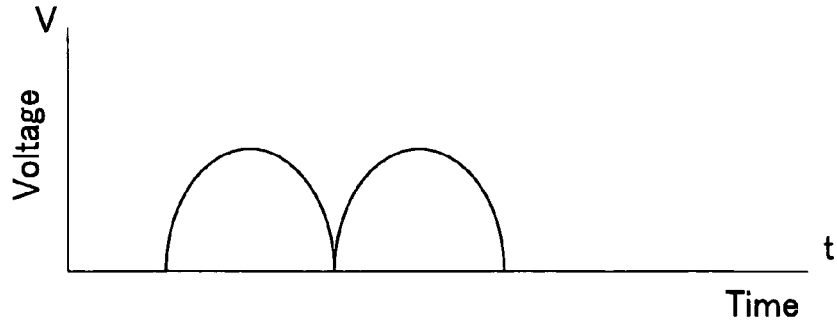

A voltage applied to the electrode plate 1 then is experimentally found, as shown in FIG. 2A, to be preferably one with a rectangular wave where a rise of the voltage is steep. That is, when applying voltages having wave characteristics shown in FIGS. 2B and 2C, a reaction becomes not more than a half.

In addition, it is preferable from a point of durability to apply positive/negative voltages to a pair of electrode plates 1 with periodically alternating the voltages.

(Electrolysis Apparatus)

Next, will be described an electrolysis apparatus provided with an electrode plate of the embodiment in the present invention, based on FIGS. 3 to 6.

Figure 3:
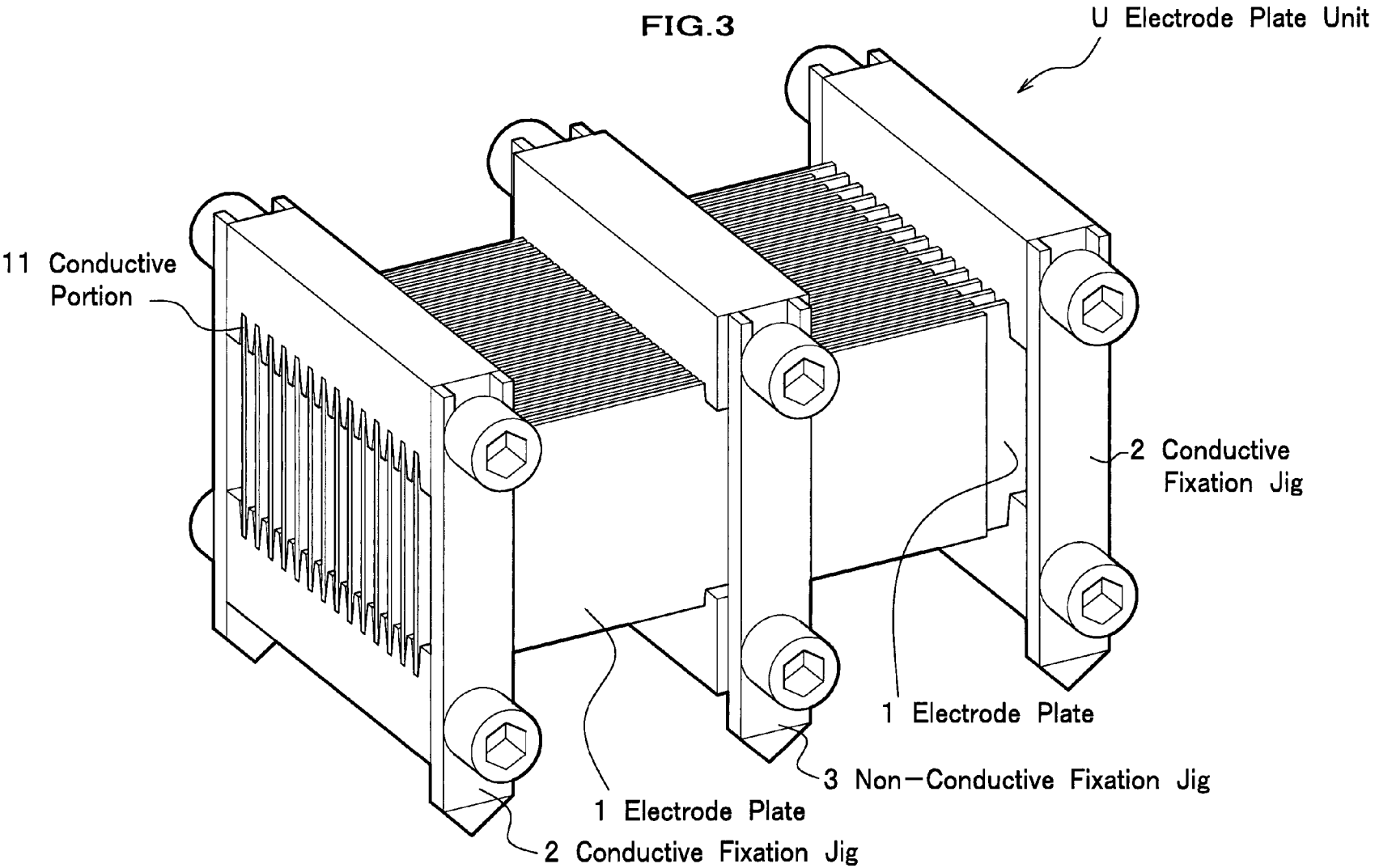
FIG. 3 is a perspective view showing an outline of an electrolysis plate unit in an electrolysis apparatus related to one embodiment of the present invention.
Figure 4:
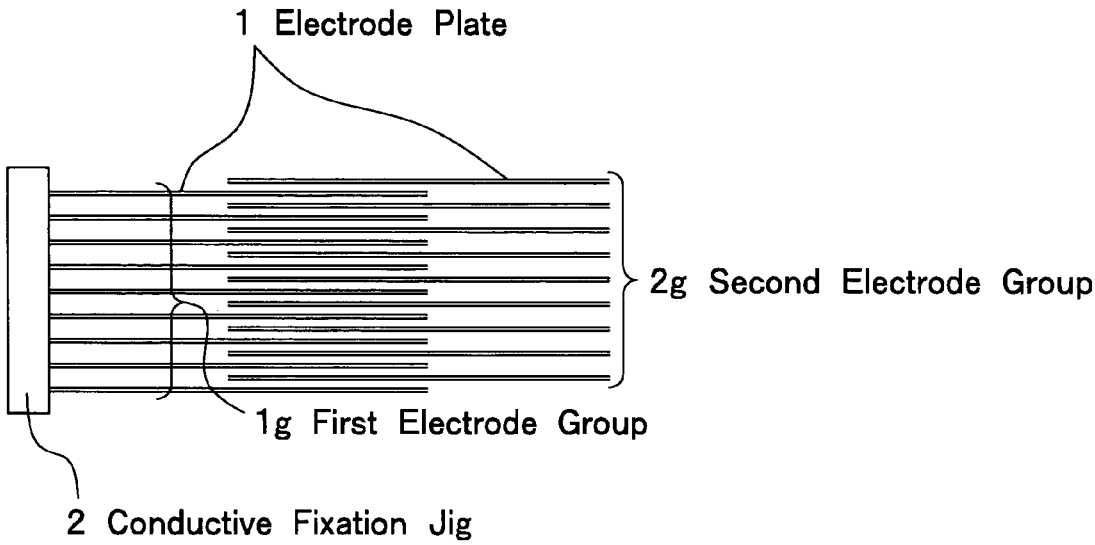
FIG. 4 is a plan view indicating first and electrode groups of the electrode plate unit shown in FIG. 3.
Figure 5A:
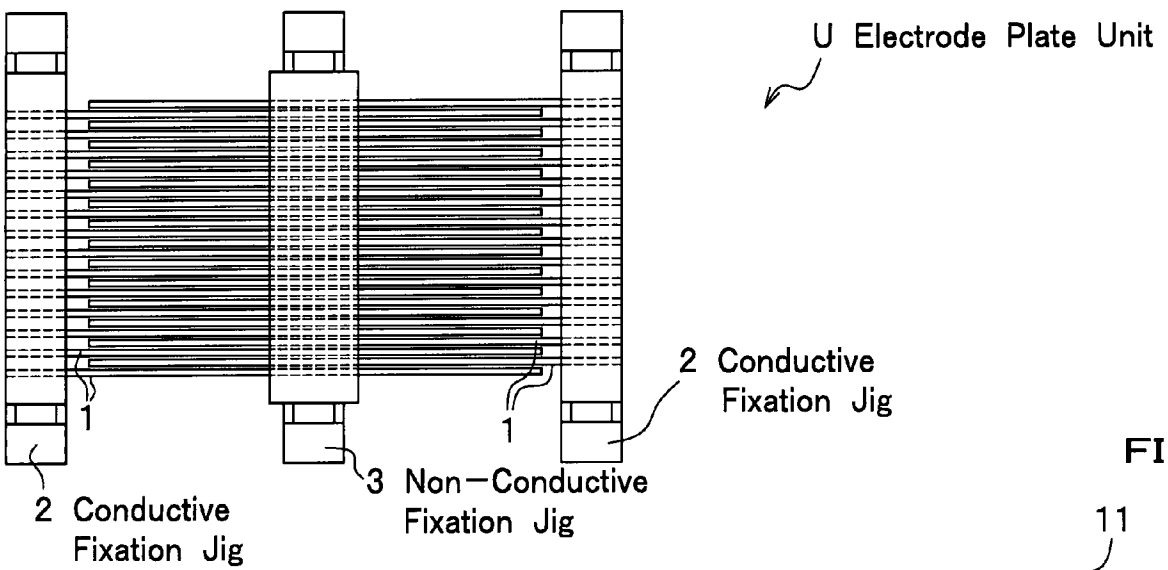
FIG. 5A is a plan view of the electrode plate unit shown in FIG. 3.
Figure 5B:
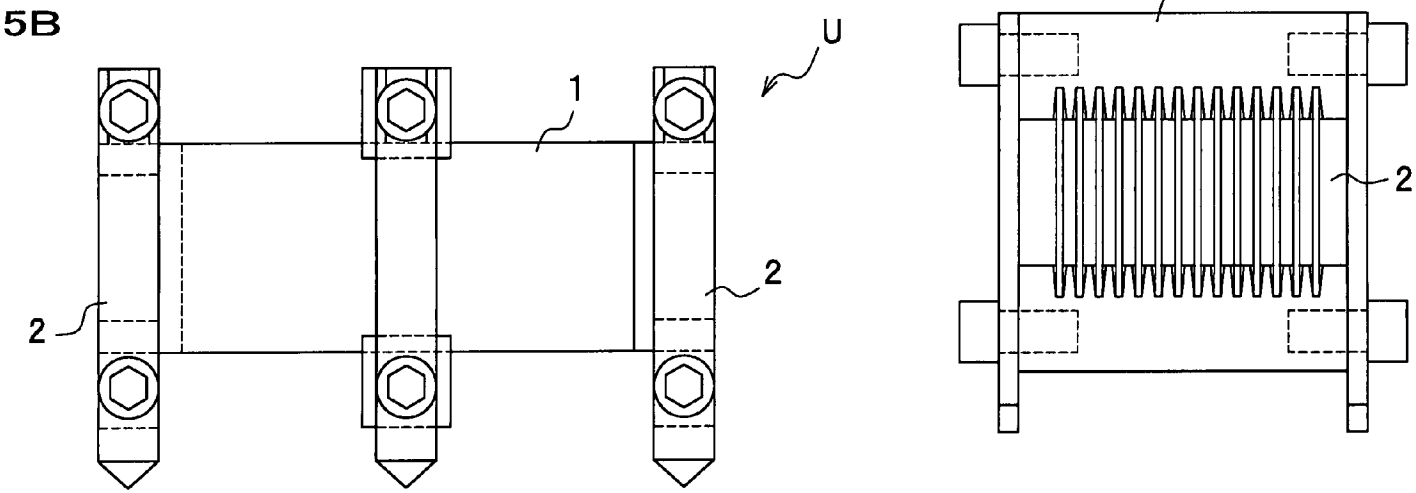
FIG. 5B is a side view of the electrode plate unit shown in FIG. 3.
Figure 5C:
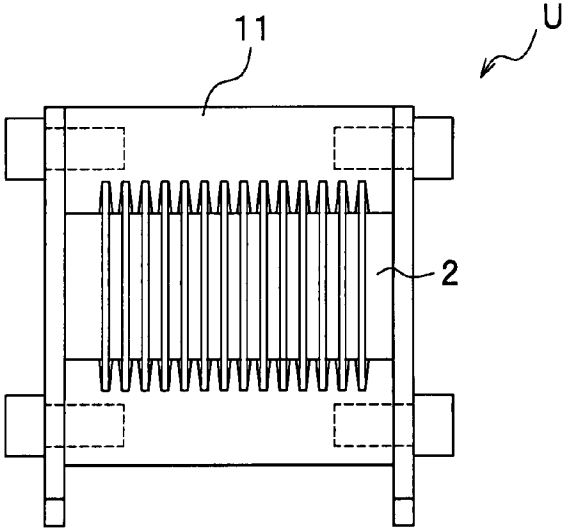
FIG. 5C is a front view of the electrode plate unit shown in FIG. 3.

As shown in FIGS. 3 to 4, an electrode plate unit U related to the embodiment mainly comprises a first electrode group 1*g*, where electrode plates 1 are arranged at a predetermined distance in parallel with a face direction of the electrode plates 1 and one end of a plurality of the electrode plates 1 is fixed by a conductive fixation jig 2; and a second electrode group 2*g*, where a plurality of the electrode plates 1 are arranged at a predetermined distance in parallel with a face direction of the plurality of the electrode plates 1 and one end of the plurality of the electrode plates 1 is fixed by another conductive fixation jig 2.

The conductive portion 11, which is comprised of a foil material of a conductive metal such as aluminum, is preferable to be provided at connection portions of the then used electrode plates 1 with relevant conductive fixation jigs 2 for a purpose of making conductivity better. Each of the conductive fixation jigs 2 forms the conductive portion 11 together with the foil material of the conductive metal and is connected to a power source by conducting wires.

The first electrode group 1g and the second electrode group 2g are combined so that the electrode plates 1 and the other electrode plates 1 are alternately arranged at a predetermined distance, preferably at a distance of 0.2 to 0.5 mm. That is, in the first electrode group 1g and the second electrode group 2g each free end thereof is faced each other, each electrode plate for composing the first electrode group 1g and the second electrode group 2g is combined and arranged not to contact each other and the opposed conductive fixation jigs 2.

Then, the first electrode group 1g and the second electrode group 2g are fixed in a face vertical direction of both the electrode groups by a non-conductive fixation jig 3 so that the electrode plates 1 and the other electrode plates 1 are not contacted. Meanwhile, the non-conductive fixation jig 3 may have a non-conductive spacer such as a rubber not shown.

By thus having the non-conductive spacer, is provided the electrode plate unit U that can implement stable electrolysis.

Figure 6:
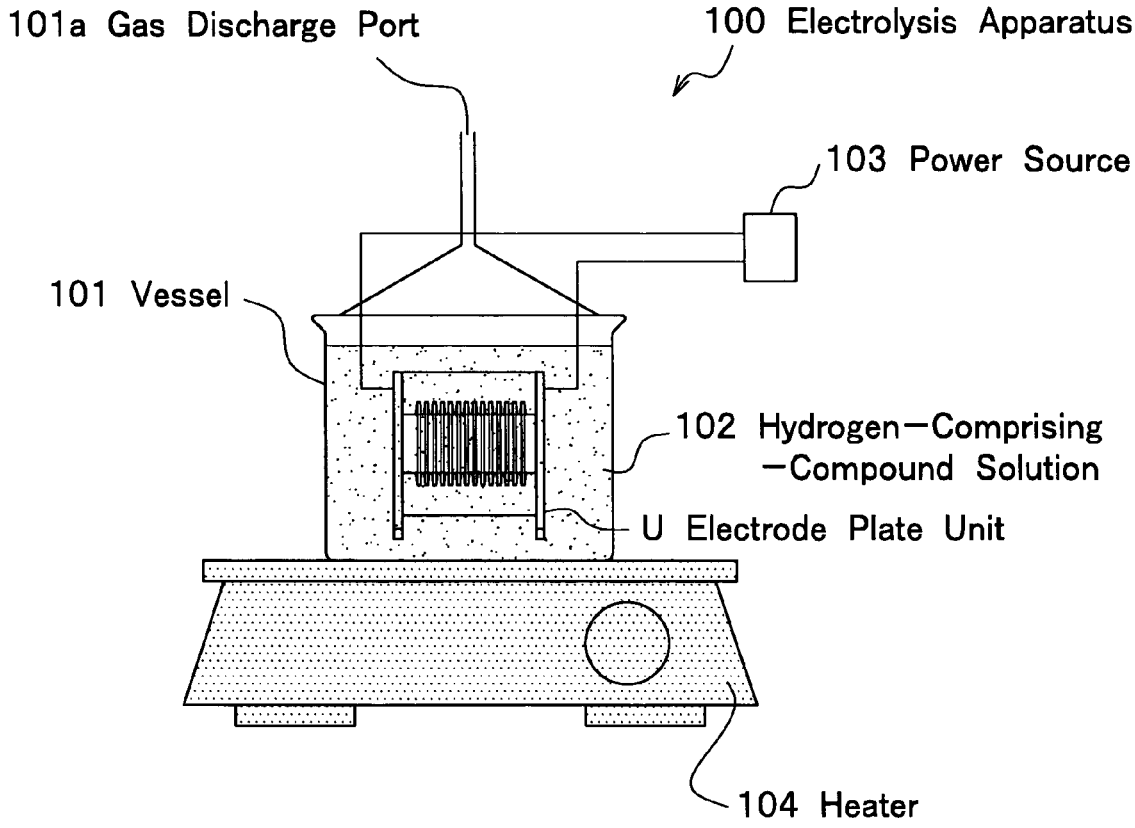
FIG. 6 is a schematic drawing showing an electrolysis apparatus where the electrode plate shown in FIG. 3 is mounted.

Such the electrode plate unit U is mounted on an electrolysis apparatus 100 as shown in FIG. 6.

The electrolysis apparatus 100 of the embodiment mainly comprises a hydrogen-comprising-compound solution 102 of a treated substance, a vessel 101 for accommodating the electrode plate unit U, and a power source 103 for applying a voltage to the electrode plate unit U.

The vessel 101 has a gas discharge port 101*a* for recovering gases generated by electrolysis on an upper surface thereof. The gas discharge port 101*a* is connected to a gas separator not shown and is designed to recover a desired gas (hydrogen) out of the generation gases.

Thus composed, it can be made to electrolyze the hydrogen-comprising-compound solution of the treated substance with low energy over a long period, using the electrode plate unit U (electrode plate 1) of the embodiment. Particularly, such the electrode plate unit U of the embodiment can efficiently arrange a plurality of electrode plates at a less space and thereby efficient electrolysis can be implemented.

Meanwhile, in order to accelerate a reaction, it is preferable to provide a heater 104 at a bottom surface.

Thus, although an electrode plate for electrolysis, an electrolysis apparatus, an electrode plate unit and an electrolysis method of a hydrogen-comprising-compound related to the present invention are described, the invention is not limited to these embodiments and various variations are available without departing from the spirit and scope of the invention.

EXAMPLE

Here will be described the present invention in detail, based on examples.

Example 1

Electrolysis of Methanol by Electrode Plate Unit

Implement electrolysis under a condition shown in Table 2 below with using the electrode plate unit U shown in FIG. 3.

TABLE 2

| | |
|---|---|
| Electrode Plates 1 | Si, 20 × 50 × 0.5 mm, a porous plate (75 to 100 μm), and 20 pieces |
| Distance Between Electrodes | 0.5 mm |
| Electrode Wire | Titan conducting wire (0.5 mm) |
| Constant Voltage Generator | Wave Factory 1045 HAS 4011 manufactured by Daido Chemical Industry CO,. LTD. |
| Voltage | AC 100 V, 0.05 Hz (20 seconds per cycle), and a short rectangular wave |
| Hydrogen-Comprising-Compound | Methanol for a test and research (purity, not less than 99.0%) |
| Air Volume at Upper Portion | 190 ml |

Heat methanol to 40 degrees Celsius in advance of a test start, further heat a liquid temperature thereof after the test start, and maintain the temperature till a test end (10 hours).

Figure 7:
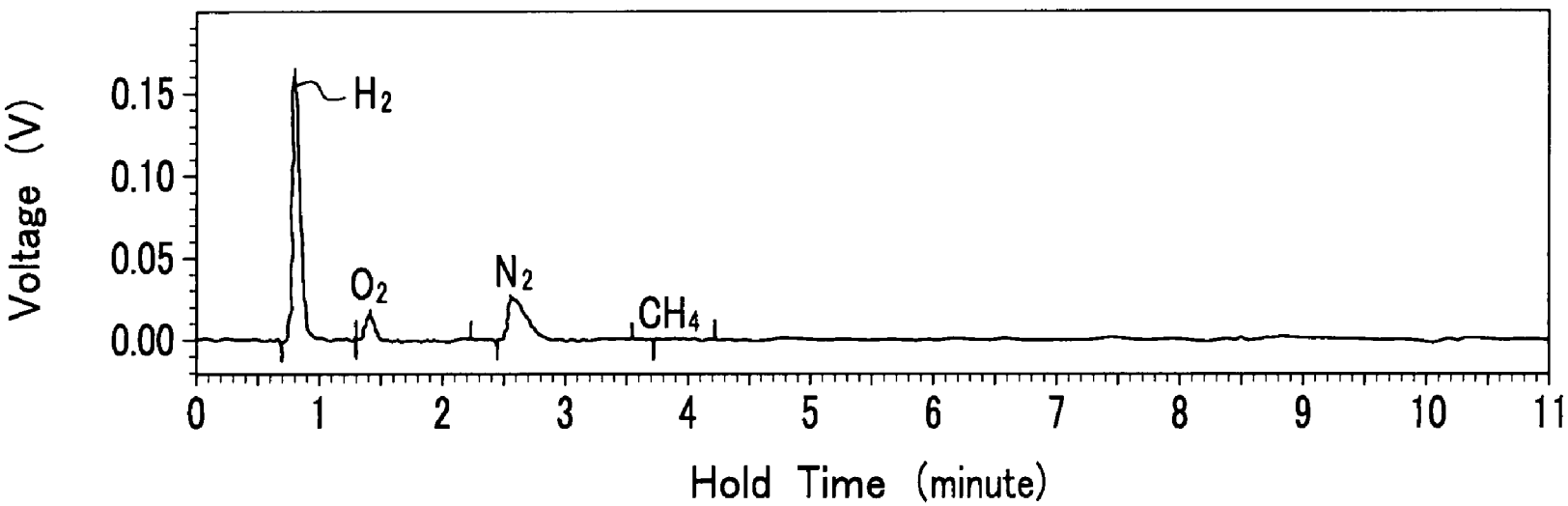
FIG. 7 is a gas chromatogram of electrolysis of methanol.

Recover generation gases in a bag made of Teflon (trademark), analyze the recovered gases by a gas chromatograph. A result thereof is shown in FIG. 7. FIG. 7 is a gas chromatogram of electrolysis of the methanol.

As shown in FIG. 7, a generation amount of gases in the test is 586 ml and these gases are $H_2$ of 63.550%, $O_2$ of 8.791%, $N_2$ of 26.795%, and $CH_4$ of 0.128% in volume percent. Meanwhile, the nitrogen is derived from air introduced at an initial stage.

From this result, it turns out that the methanol, which is conventionally impossible to be electrolyzed, can be electrolyzed with giving low energy by an electrolysis apparatus of the present invention.

Example 2

After implementing electrolysis in the example 1, stop a voltage application and further continue the electrolysis for 20 hours. A result thereof is shown in Table 3.

TABLE 3

| Gas Generation Amount (after 20 hours) | 40 ml |
|---|---|
| Generation Gas | |
| $H_2$ | 16.181 mol % (37.216 ml) |
| $O_2$ | 16.705 mol % (38.422 ml) |
| $N_2$ | 65.736 mol % (151.193 ml) |
| $CH_4$ | 0.079 mol % (0.182 ml) |
| $CO_2$ | 1.299 mol % (2.987 ml) |

Meanwhile, subtracting $O_2$ and $N_2$ of constituents of air, it turns out that $H_2$ (90.135%, 37.216 ml), $CH_4$ (0.451%, 0.182 ml), and $CO_2$ (7.396%, 2.987 ml) are generated. In accordance with the reaction a generation of CO of a harmful composition is not observed.

What is claimed is:

1. An electrode plate for electrolysis comprising:

a plate-form porous body for electrolyzing a hydrogen-comprising-compound solution; and a conductive portion provided at a part of said body, wherein particles for composing said body comprise a fluoride carbon and an element difficult to react to oxygen, said element being an element of a simple constituent selected from a group comprising silicon, titan, nickel, and samarium, and wherein an outmost-nucleus-orbit electron number of said element is even, and porosity having an energy concentration field is provided between said particles in said body.

2. An electrode plate for electrolysis according to claim 1, wherein said body is composed of particles whose diameter is from 30 μm to 150 μm.

3. An electrolysis apparatus according to claim 2 comprising:

at least a pair of electrode plates for electrolysis;

a power source that is connected to a conductive portion of the electrode plates for said electrolysis through conducting wires and applies a voltage to the conductive portion; and a vessel that accommodates the electrode plates for said electrolysis and a hydrogen-comprising-compound solution and has a gas discharge port.

4. An electrolysis apparatus according to claim 3 wherein said power source applies a voltage to said electrode plates so as to periodically change a potential.

5. An electrolysis apparatus according to claim 4 wherein said power source applies a voltage of a rectangular wave to said electrode plates.

6. An electrolysis apparatus according to claim 5 comprising:

each of said electrode plates as an electrode plate unit;

a first electrode group that arranges a plurality of said electrode plates at a predetermined distance in parallel with a face direction thereof, and one end of the plurality of said electrode plates is fixed by a conductive fixation jig; and a second electrode group that arranges a plurality of said electrode plates at a predetermined distance in parallel with a face direction thereof, and one end of the plurality of said electrode plates is fixed by another conductive fixation jig, wherein in said electrode plate unit each free end of said first electrode group and said second electrode group is made face to face, each of said electrode plates for composing each of said electrode groups is arranged not to contact each other and the opposed conductive fixation jigs, said first electrode group and said second electrode group are fixed by the conductive fixation jigs in a vertical direction of a face of said electrode groups, and a conductive portion of each of said electrode plates is formed so as to contact the conductive fixation jig of each of said electrode groups.

7. An electrolysis apparatus according to claim 4 comprising:

each of said electrode plates as an electrode plate unit;

a first electrode group that arranges a plurality of said electrode plates at a predetermined distance in parallel with a face direction thereof, and one end of the plurality of said electrode plates is fixed by a conductive fixation jig; and a second electrode group that arranges a plurality of said electrode plates at a predetermined distance in parallel with a face direction thereof, and one end of the plurality of said electrode plates is fixed by another conductive fixation jig, wherein in said electrode plate unit each free end of said first electrode group and said second electrode group is made face to face, each of said electrode plates for composing each of said electrode groups is arranged not to contact each other and the opposed conductive fixation jigs, said first electrode group and said second electrode group are fixed by the conductive fixation jigs in a vertical direction of a face of said electrode groups, and a conductive portion of each of said electrode plates is formed so as to contact the conductive fixation jig of each of said electrode groups.

8. An electrolysis apparatus according to claim 3 wherein said power source applies a voltage of a rectangular wave to said electrode plates.

9. An electrolysis apparatus according to claim 8 comprising:

each of said electrode plates as an electrode plate unit;

a first electrode group that arranges a plurality of said electrode plates at a predetermined distance in parallel with a face direction thereof, and one end of the plurality of said electrode plates is fixed by a conductive fixation jig; and a second electrode group that arranges a plurality of said electrode plates at a predetermined distance in parallel with a face direction thereof, and one end of the plurality of said electrode plates is fixed by another conductive fixation jig, wherein in said electrode plate unit each free end of said first electrode group and said second electrode group is made face to face, each of said electrode plates for composing each of said electrode groups is arranged not to contact each other and the opposed conductive fixation jigs, said first electrode group and said second electrode group are fixed by the conductive fixation jigs in a vertical direction of a face of said electrode groups, and a conductive portion of each of said electrode plates is formed so as to contact the conductive fixation jig of each of said electrode groups.

10. An electrolysis apparatus according to claim 3 comprising:

each of said electrode plates as an electrode plate unit;

a first electrode group that arranges a plurality of said electrode plates at a predetermined distance in parallel with a face direction thereof, and one end of the plurality of said electrode plates is fixed by a conductive fixation jig; and a second electrode group that arranges a plurality of said electrode plates at a predetermined distance in parallel with a face direction thereof, and one end of the plurality of said electrode plates is fixed by another conductive fixation jig, wherein in said electrode plate unit each free end of said first electrode group and said second electrode group is made face to face, each of said electrode plates for composing each of said electrode groups is arranged not to contact each other and the opposed conductive fixation jigs, said first electrode group and said second electrode group are fixed by the conductive fixation jigs in a vertical direction of a face of said electrode groups, and a conductive portion of each of said electrode plates is formed so as to contact the conductive fixation jig of each of said electrode groups.

11. An electrode plate unit for electrolysis for electrolyzing a hydrogen-comprising-compound solution, the unit comprising:

a first electrode group that arranges a plurality of said electrode plates according to claim 2 at a predetermined distance in parallel with a face direction thereof, and one end of the plurality of said electrode plates is fixed by a conductive fixation jig; and a second electrode group that arranges a plurality of said electrode plates at a predetermined distance in parallel with a face direction thereof, and one end of the plurality of said electrode plates is fixed by another conductive fixation jig, wherein said electrode plates of said second electrode plates for electrolysis comprises a plate-form porous body for electrolyzing a hydrogen-comprising-compound solution and a conductive portion provided at a part of said body, wherein particles for composing said body are comprised of any of fluoride carbon and an element difficult to react to oxygen, and wherein an outmost-nucleus-orbit electron number of said element is even, and porosity having an energy concentration field is provided between said particles in said body.

12. An electrode plate unit for electrolysis for electrolyzing a hydrogen-comprising-compound solution, the unit comprising:

a first electrode group that arranges a plurality of said electrode plates according to claim 2 at a predetermined distance in parallel with a face direction thereof, and one end of the plurality of said electrode plates is fixed by a conductive fixation jig; and a second electrode group that arranges a plurality of said electrode plates at a predetermined distance in parallel with a face direction thereof, and one end of the plurality of said electrode plates is fixed by another conductive fixation jig, wherein said electrode plates for electrolysis comprises a plate-form porous body for electrolyzing a hydrogen-comprising-compound solution and a conductive portion provided at a part of said body, wherein particles for composing said body are comprised of any of fluoride carbon and an element difficult to react to oxygen, and wherein an outmost-nucleus-Orbit electron number of said element is even, and porosity having an energy concentration field is provided between said particles in said body, wherein said element is designed to be an element of a simple constituent selected from a group comprising silicon, titan, nickel, and samarium.

13. An electrode plate unit for electrolysis for electrolyzing a hydrogen-comprising-compound solution, the unit comprising:

a first electrode group that arranges a plurality of said electrode plates according to claim 2 at a predetermined distance in parallel with a face direction thereof, and one end of the plurality of said electrode plates is fixed by a conductive fixation jig; and a second electrode group that arranges a plurality of said electrode plates same as said electrode plates of the first electrode group at a predetermined distance in parallel with a face direction thereof, and one end of the plurality of said electrode plates is fixed by another conductive fixation jig, wherein said electrode plates for electrolysis comprises a plate-form porous body for electrolyzing a hydrogen-comprising-compound, solution and a conductive portion provided at a part of said body, wherein particles for composing said body are comprised of any of fluoride carbon and an element difficult to react to oxygen, and wherein an outmost-nucleus-orbit electron number of said element is even, and porosity having an energy concentration field is provided between said particles in said body, wherein said body is composed of particles whose diameter is from 30 μm to 150 μm.

14. An electrode plate unit for electrolysis for electrolyzing a hydrogen-comprising-compound solution, the unit comprising:

a first electrode group that arranges a plurality of said electrode plates according to claim 2 at a predetermined distance in parallel with a face direction thereof, and one end of the plurality of said electrode plates is fixed by a conductive fixation jig; and a second electrode group that arranges a plurality of said electrode plates at a predetermined distance in parallel with a face direction thereof, and one end of the plurality of said electrode plates is fixed by another conductive fixation jig, wherein said electrode plates of said second electrode plates for electrolysis comprises a plate-form porous body for electrolyzing a hydrogen-comprising-compound solution and a conductive portion provided at a part of said body, wherein particles for composing said body are comprised of any of fluoride carbon and an element difficult to react to oxygen, and wherein an outmost-nucleus-orbit electron number of said element is even, and porosity having an energy concentration field is provided between said particles in said body, wherein said body is composed of particles whose diameter is from 30 μm to 150 μm.

15. An electrolysis apparatus according to claim 1 comprising:

at least a pair of electrode plates for electrolysis;

a power source that is connected to a conductive portion of the electrode plates for said electrolysis through conducting wires and applies a voltage to the conductive portion; and a vessel that accommodates the electrode plates for said electrolysis and a hydrogen-comprising-compound solution and has a gas discharge port.

16. An electrolysis apparatus according to claim 15, wherein said power source applies a voltage to said electrode plates so as to periodically change a potential.

17. An electrolysis apparatus according to claim 16 wherein said power source applies a voltage of a rectangular wave to said electrode plates.

18. An electrolysis apparatus according to claim 17 comprising:

each of said electrode plates as an electrode plate unit;

a first electrode group that arranges a plurality of said electrode plates at a predetermined distance in parallel with a face direction thereof, and one end of the plurality of said electrode plates is fixed by a conductive fixation jig; and a second electrode group that arranges a plurality of said electrode plates at a predetermined distance in parallel with a face direction thereof, and one end of the plurality of said electrode plates is fixed by another conductive fixation jig, wherein in said electrode plate unit each free end of said first electrode group and said second electrode group is made face to face, each of said electrode plates for composing each of said electrode groups is arranged not to contact each other and the opposed conductive fixation jigs, said first electrode group and said second electrode group are fixed by the conductive fixation jigs in a vertical direction of a face of said electrode groups, and a conductive portion of each of said electrode plates is formed so as to contact the conductive fixation jig of each of said electrode groups.

19. An electrolysis apparatus according to claim 16 comprising:

each of said electrode plates as an electrode plate unit;

a first electrode group that arranges a plurality of said electrode plates at a predetermined distance in parallel with a face direction thereof, and one end of the plurality of said electrode plates is fixed by a conductive fixation jig; and a second electrode group that arranges a plurality of said electrode plates at a predetermined distance in parallel with a face direction thereof, and one end of the plurality of said electrode plates is fixed by another conductive fixation jig, wherein in said electrode plate unit each free end of said first electrode group and said second electrode group is made face to face, each of said electrode plates for composing each of said electrode groups is arranged not to contact each other and the opposed conductive fixation jigs, said first electrode group and said second electrode group are fixed by the conductive fixation jigs in a vertical direction of a face of said electrode groups, and a conductive portion of each of said electrode plates is formed so as to contact the conductive fixation jig of each of said electrode groups.

20. An electrolysis apparatus according to claim 15 wherein said power source applies a voltage of a rectangular wave to said electrode plates.

21. An electrolysis apparatus according to claim 20 comprising:

each of said electrode plates as an electrode plate unit;

a first electrode group that arranges a plurality of said electrode plates at a predetermined distance in parallel with a face direction thereof, and one end of the plurality of said electrode plates is fixed by a conductive fixation jig; and a second electrode group that arranges a plurality of said electrode plates at a predetermined distance in parallel with a face direction thereof, and one end of the plurality of said electrode plates is fixed by another conductive fixation jig, wherein in said electrode plate unit each free end of said first electrode group and said second electrode group is made face to face, each of said electrode plates for composing each of said electrode groups is arranged not to contact each other and the opposed conductive fixation jigs, said first electrode group and said second electrode group are fixed, by the conductive fixation jigs in a vertical direction of a face of said electrode groups, and a conductive portion of each of said electrode plates is formed so as to contact the conductive fixation jig of each of said electrode groups.

22. An electrolysis apparatus according to claim 15 comprising:

each of said electrode plates as an electrode plate unit;

a first electrode group that arranges a plurality of said electrode plates at a predetermined distance in parallel with a face direction thereof, and one end of the plurality of said electrode plates is fixed by a conductive fixation jig; and a second electrode group that arranges a plurality of said electrode plates at a predetermined distance in parallel with a face direction thereof, and one end of the plurality of said electrode plates is fixed by another conductive fixation jig, wherein in said electrode plate unit each free end of said first electrode group and said second electrode group is made face to face, each of said electrode plates for composing each of said electrode groups is arranged not to contact each other and the opposed conductive fixation jigs, said first electrode group and said second electrode group are fixed by the conductive fixation jig in a vertical direction of a face of said electrode groups, and a conductive portion of each of said electrode plates is formed so as to contact the conductive fixation jig of each of said electrode groups.

23. An electrode plate unit for electrolysis for electrolyzing a hydrogen-comprising-compound solution, the unit comprising:

a first electrode group that arranges a plurality of said electrode plates according to claim 1 at a predetermined distance in parallel with a face direction thereof, and one end of the plurality of said electrode plates is fixed by a conductive fixation jig; and a second electrode group that arranges a plurality of said electrode plates same as said electrode plates of the first electrode group at a predetermined distance in parallel with a face direction thereof, and one end of the plurality of said electrode plates is fixed by another conductive fixation jig, wherein said electrode plates for electrolysis comprises a plate-form porous body for electrolyzing a hydrogen-comprising-compound solution and a conductive portion provided at a part of said body, wherein particles for composing said body are comprised of any of fluoride carbon and an element difficult to react to oxygen, and wherein an outmost-nucleus-Orbit electron number of said element is even, and porosity having an energy concentration field is provided between said particles in said body.

24. An electrode plate unit for electrolysis for electrolyzing a hydrogen-comprising-compound solution, the unit comprising:

a first electrode group that arranges a plurality of said electrode plates according to claim 1 at a predetermined distance in parallel with a face direction thereof, and one end of the plurality of said electrode plates is fixed by a conductive fixation jig; and a second electrode group that arranges a plurality of said electrode plates at a predetermined distance in parallel with a face direction thereof, and one end of the plurality of said electrode plates is fixed by another conductive fixation jig, wherein said electrode plates of said second electrode plates for electrolysis comprises a plate-form porous body for electrolyzing a hydrogen-comprising-compound solution and a conductive portion provided at a part of said body, wherein particles for composing said body are comprised of any of fluoride carbon and an element difficult to react to oxygen, and wherein an outmost-nucleus-orbit electron number of said element is even, and porosity having an energy concentration field is provided between said particles in said body, wherein said element is designed to be an element of a simple constituent selected from a group comprising silicon, titan, nickel, and samarium.

25. An electrode plate unit for electrolysis for electrolyzing a hydrogen-comprising-compound solution, the unit comprising:

a first electrode group that arranges a plurality of said electrode plates according to claim 1 at a predetermined distance in parallel with a face direction thereof, and one end of the plurality of said electrode plates is fixed by a conductive fixation jig; and a second electrode group that arranges a plurality of said electrode plates at a predetermined distance in parallel with a face direction thereof, and one end of the plurality of said electrode plates is fixed by another conductive fixation jig, wherein said electrode plates of said second electrode plates for electrolysis comprises a plate-form porous body for electrolyzing a hydrogen-comprising-compound solution and a conductive portion provided at a part of said body, wherein particles for composing said body are comprised of any of fluoride carbon and an element difficult to react to oxygen, and wherein an outmost-nucleus-orbit electron number of said element is even, and porosity having an energy concentration field is provided between said particles in said body, wherein said body is composed of particles whose diameter is from 30 μm to 150μm.

26. An electrode plate unit for electrolysis for electrolyzing a hydrogen-comprising-compound solution, the unit comprising:

a first electrode group that arranges a plurality of said electrode plates according to claim 1 at a predetermined distance in parallel with a face direction thereof, and one end of the plurality of said electrode plates is fixed by a conductive fixation jig; and a second electrode group that arranges a plurality of said electrode plates at a predetermined distance in parallel with a face direction thereof, and one end of the plurality of said electrode plates is fixed by another conductive fixation jig, wherein said electrode plates of said second electrode plates for electrolysis comprises a plate-form porous body for electrolyzing a hydrogen-comprising-compound solution and a conductive portion provided at a part of said body, wherein particles for composing said body are comprised of any of fluoride carbon and an element difficult to react to oxygen, and wherein an outmost-nucleus-orbit electron number of said element is even, and porosity having an energy concentration field is provided between said particles in said body, wherein said body is composed of particles whose diameter is from 30 μm to 150 μm.

27. An electrolysis method comprising:

applying a voltage to a conductive portion via a power source that is connected to the conductive portion of at least a pair of electrode plates for electrolysis through conducting wires and electrolyzing a hydrogen-comprising-compound solution under heating. wherein a vessel that accommodates the electrode plates for said electrolysis and a hydrogen-comprising-compound solution has a gas discharge port; and stopping an application of the voltage and continuing on electrolyzing said hydrogen-comprising-compound solution under heating via a plate-form porous body having a conductive portion provided at a part of said body.

wherein particles for composing said body comprise a fluoride carbon and an element difficult to react to oxygen, said element being an element of a simple constituent selected from a group comprising silicon, titan, nickel, and samarium, and wherein an outmost-nucleus-orbit electron number of said element is even, and porosity having an energy concentration field is provided between said particles in said body.

28. An electrolysis method according to claim 27 wherein said porous body is composed of particles whose diameter is from 30 μm to 150 μm

29. An electrolysis method according to claim 28 wherein said power source applies a voltage to said electrode plates so as to periodically change a potential.

30. An electrolysis method according to claim 29 wherein said power source applies a voltage of a rectangular wave to said electrode plates.

31. An electrolysis method according to claim 28 wherein said power source applies a voltage of a rectangular wave to said electrode plates.

32. An electrolysis method according to claim 27 wherein said power source applies a voltage to said electrode plates so as to periodically change a potential.

33. An electrolysis method according to claim 32 wherein said power source applies a voltage of a rectangular wave to said electrode plates.

34. An electrolysis method according to claim 27 wherein said power source applies a voltage of a rectangular wave to said electrode plates.

35. An electrolysis method comprising:

applying a voltage to a conductive portion via a power source that is connected to the conductive portion of at least a pair of electrode plates for electrolysis through conducting wires and electrolyzing a hydrogen-comprising-compound solution under heating, wherein a vessel that accommodates the electrode plates for said electrolysis and a hydrogen-comprising-compound solution has a gas discharge port; and stopping an application of the voltage and continuing on electrolyzing said hydrogen-comprising-compound solution under heating via a plate-form porous body having a conductive portion provided at a part of said body, wherein each of said electrode plates as an electrode plate unit;

a first electrode group that arranges a plurality of said electrode plates at a predetermined distance in parallel with a face direction thereof. and one end of the plurality of said electrode plates is fixed by a conductive fixation jig; and a second electrode group that arranges a plurality of said electrode plates at a predetermined distance in parallel with a face direction thereof. and one end of the plurality of said electrode plates is fixed by another conductive fixation jig;

wherein in said electrode plate unit each free end of said first electrode group and said second electrode group is made face to face, each of said electrode plates for composing each of said electrode groups is arranged not to contact each other and the opposed conductive fixation jigs, said first electrode group and said second electrode group are fixed by the conductive fixation jig in a vertical direction of a face of said electrode groups, and a conductive portion of each of said electrode plates is formed so as to contact the conductive fixation up of each of said electrode groups;

wherein particles for composing said body comprise a fluoride carbon and an element difficult to react to oxygen, said element being an element of a simple constituent selected from a group comprising silicon, titan, nickel, and samarium, and wherein an outmost-nucleus-orbit electron number of said element is even, and porosity having an energy concentration field is provided between said particles in said body.

36. An electrolysis method according to claim 35 wherein said porous body is composed of particles whose diameter is from 30 μm to 150 μm.

37. An electrolysis method according to claim 36, wherein said power source applies a voltage to said electrode plates so as to periodically change a potential.

38. An electrolysis method according to claim 37 wherein said power source applies a voltage of a rectangular wave to said electrode plates.

39. An electrolysis method according to claim 36 wherein said power source applies a voltage of a rectangular wave to said electrode plates.

40. An electrolysis method according to claim 35 wherein said power source applies a voltage to said electrode plates so as to periodically change a potential.

41. An electrolysis method according to claim 40 wherein said power source applies a voltage of a rectangular wave to said electrode plates.

42. An electrolysis method according to claim 35 wherein said power source applies a voltage of a rectangular wave to said electrode plates.

* * * * *